US009016027B1

(12) United States Patent
Kreizinger

(10) Patent No.: US 9,016,027 B1
(45) Date of Patent: Apr. 28, 2015

(54) METHOD OF BUILDING INSULATED CONCRETED WALL

(71) Applicant: Kenneth Robert Kreizinger, Fort Lauderdale, FL (US)

(72) Inventor: Kenneth Robert Kreizinger, Fort Lauderdale, FL (US)

( * ) Notice: Subject to any disclaimer, the term of this patent is extended or adjusted under 35 U.S.C. 154(b) by 0 days.

(21) Appl. No.: 13/815,279

(22) Filed: Feb. 15, 2013

Related U.S. Application Data

(63) Continuation-in-part of application No. 12/932,657, filed on Mar. 2, 2011, now abandoned, and a continuation-in-part of application No. 13/374,839, filed on Jan. 17, 2012, and a continuation-in-part of application No. 13/373,816, filed on Dec. 1, 2011, now Pat. No. 8,621,817.

(51) Int. Cl.
*E04B 1/16* (2006.01)
*E04B 2/86* (2006.01)

(52) U.S. Cl.
CPC ..... *E04B 2/8647* (2013.01)

(58) Field of Classification Search
CPC ..... E04B 2/8635; E04B 1/14; E04C 2/384; E04C 2/288; E04C 2/296
USPC ..... 52/267, 269, 309.7, 309.8, 52/309.12–309.14, 309.17, 404.2, 434, 52/435, 745.09, 745.1
See application file for complete search history.

(56) References Cited

U.S. PATENT DOCUMENTS 3,754,066 A * 8/1973 Black ..... 264/71
3,994,471 A * 11/1976 Turolla ..... 249/205
4,292,783 A 10/1981 Mulvihill
4,336,676 A 6/1982 Artzer
4,454,702 A 6/1984 Bonilla-Lugo et al.
4,553,363 A * 11/1985 Weinar ..... 52/288.1
4,641,468 A 2/1987 Slater
5,335,472 A 8/1994 Phillips
5,554,392 A * 9/1996 Gray ..... 425/64
5,558,823 A * 9/1996 Gray ..... 264/33
5,799,453 A 9/1998 Westerlund
5,803,964 A 9/1998 Scarborough
5,845,445 A 12/1998 Blackbeard
5,861,105 A 1/1999 Martineau
6,041,561 A * 3/2000 LeBlang ..... 52/234

(Continued)

FOREIGN PATENT DOCUMENTS

DE 3326856 A1 * 2/1985
GB 1528207 A * 10/1978

OTHER PUBLICATIONS

U.S. Appl. No. 13/374,839, filed Jan. 17, 2012, Kreizinger.

(Continued)

*Primary Examiner* — Adriana Figueroa

(57) ABSTRACT

A method of building insulated concrete walls by using concrete that exerts low hydrostatic pressure and a special stud that supports and secures simple rectangular shaped insulation boards used as stay-in-place forms on one side of the wall. The construction process begins with the vertical positioning of the studs and insulation boards on one side of the wall. Steel reinforcement is placed next to the insulation boards and low hydrostatic pressure producing concrete is cast against the reinforcement, the exposed part of the stud and the insulation board. As the concrete is placed it embeds the exposed part of the stud and when the concrete cures it causes the stud to be bonded to the concrete and sufficiently rigid to secure the insulation board and wallboard or other cladding that may be affixed to the stud.

10 Claims, 5 Drawing Sheets

(56) References Cited

U.S. PATENT DOCUMENTS

| | | | | |
|---|---|---|---|---|
| 6,079,176 | A | 6/2000 | Westra et al. | |
| 6,112,489 | A * | 9/2000 | Zweig | 52/405.1 |
| 6,202,375 | B1 | 3/2001 | Kleinschmidt | |
| 6,226,942 | B1 | 5/2001 | Bonin | |
| 6,250,033 | B1 * | 6/2001 | Zelinsky | 52/275 |
| 6,263,628 | B1 | 7/2001 | Griffin | |
| 6,279,285 | B1 | 8/2001 | Kubica | |
| 6,314,694 | B1 | 11/2001 | Cooper et al. | |
| 6,519,904 | B1 * | 2/2003 | Phillips | 52/309.12 |
| 6,622,444 | B2 | 9/2003 | Zarate Sanchez et al. | |
| 6,634,148 | B2 | 10/2003 | Shidler | |
| 6,698,710 | B1 * | 3/2004 | VanderWerf | 249/216 |
| 6,705,055 | B2 | 3/2004 | Ritter et al. | |
| 6,718,712 | B1 | 4/2004 | Heath | |
| 6,926,851 | B2 * | 8/2005 | Colavito et al. | 264/33 |
| 7,059,577 | B1 * | 6/2006 | Burgett | 249/40 |
| 7,067,588 | B2 | 6/2006 | Ritter et al. | |
| 7,353,642 | B1 | 4/2008 | Henriquez | |
| 7,666,258 | B2 * | 2/2010 | Guevara et al. | 106/724 |
| 7,790,302 | B2 * | 9/2010 | Ladely (Guevara) et al. | 428/703 |
| 7,963,080 | B1 * | 6/2011 | Bowman | 52/414 |
| 8,176,696 | B2 * | 5/2012 | LeBlang | 52/309.12 |
| 2001/0000844 | A1 | 5/2001 | Kubica | |
| 2003/0070379 | A1 | 4/2003 | Worley | |
| 2005/0252117 | A1 * | 11/2005 | Disterhof et al. | 52/223.6 |
| 2009/0107065 | A1 | 4/2009 | LeBlang | |
| 2009/0133343 | A1 | 5/2009 | Tedder | |
| 2009/0218474 | A1 | 9/2009 | Bowman | |
| 2009/0301030 | A1 * | 12/2009 | Nojima et al. | 52/782.1 |
| 2010/0058700 | A1 | 3/2010 | Leblang | |

OTHER PUBLICATIONS

U.S. Appl. No. 13/373,816, filed Dec. 1, 2011, Kreizinger.
U.S. Appl. No. 12/932,657, filed Mar. 2, 2011, Kreizinger.

* cited by examiner

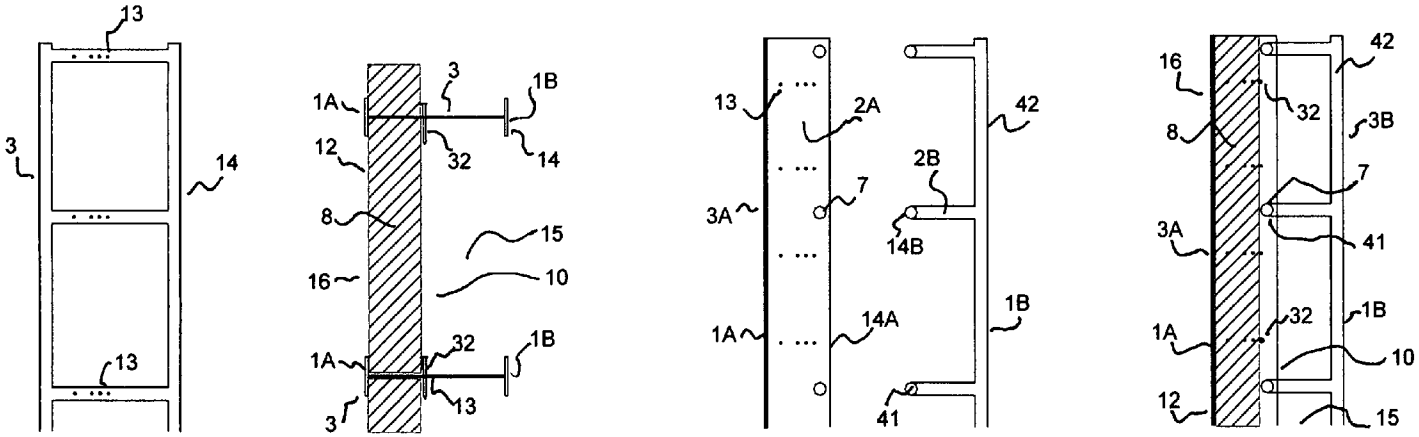
FIG. 21A
FIG. 21B
FIG. 22A
FIG. 23
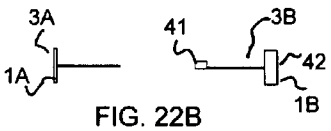
FIG. 22B
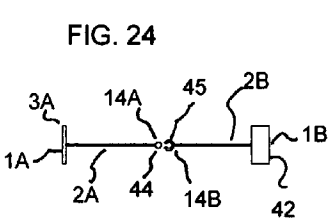
FIG. 24
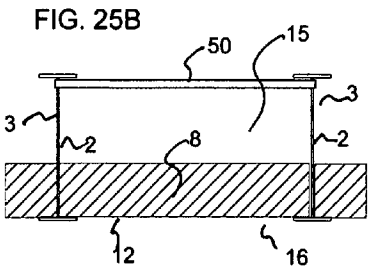
FIG. 25B
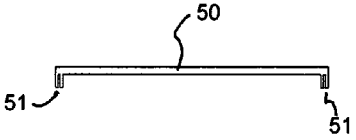
FIG. 25A

METHOD OF BUILDING INSULATED CONCRETED WALL

CROSS-REFERENCE TO RELATED APPLICATIONS

This application is a continuation-in-part of application Ser. No. 12/932,657 filed Mar. 2, 2011 which claims the benefit of the filing date of provisional application Nos. 61/339,330 filed Mar. 3, 2010. This application claims the benefit of copending application Ser. No. 13/374,839 filed Jan. 17, 2012 claiming the benefit of the filing date of provisional application Nos. 61/461,437 filed Jan. 18, 2011 and 61/462,463 filed Feb. 3, 2011. This application claims the benefit of copending application Ser. No. 13/373,816 filed Dec. 1, 2011 claiming the benefit of the filing date of provisional application Nos. 61/458,934 filed Dec. 3, 2010 and 61/461,436 filed Jan. 18, 2011. All the above cited applications are incorporated herein by reference.

BACKGROUND OF THE INVENTION

Prior Art

The following is a tabulation of some prior art that presently appears relevant:

U.S. Patents

| U.S. Pat. No. | Kind Code | Issue Date | Patentee |
|---|---|---|---|
| 7,353,642 | B1 | 2008-04-8 | Hendriquez |
| 7,067,588 | B2 | 2006-06-27 | Ritter et al. |
| 7,059,577 | B1 | 2006-06-13 | Burgett |
| 6,718,712 | B1 | 2004-04-13 | Heath |
| 6,705,055 | B2 | 2004-03-16 | Ritter et al. |
| 6,698,710 | B1 | 2004-03-2 | VanderWerf |
| 6,634,148 | B2 | 2003-10-21 | Shidler |
| 6,622,444 | B2 | 2003-09-23 | Zarate Sanchez et al. |
| 6,519,904 | B1 | 2003-02-18 | Phillips |
| 6,314,694 | B1 | 2001-11-13 | Cooper et al. |
| 6,279,285 | B1 | 2001-08-28 | Kubica |
| 6,263,628 | B1 | 2001-07-24 | Griffin G. E. Steel |
| 6,226,942 | B1 | 2001-05-8 | Bonin |
| 6,202,375 | B1 | 2001-03-20 | Kleinschmidt |
| 6,112,489 | | 2000-09-5 | Zweig |
| 6,079,176 | | 2000-06-27 | Westra et al. |
| 6,041,561 | | 2000-03-28 | LeBlang |
| 5,861,105 | | 1999-01-19 | Martineau |
| 5,845,445 | | 1998-12-8 | Blackbeard |
| 5,803,964 | | 1998-09-8 | Scarborough |
| 5,799,453 | | 1998-09-1 | Westerlund |
| 5,335,472 | | 1994-08-9 | Phillips |
| 4,641,468 | | 1987-02-10 | Slater |
| 4,553,363 | | 1985-11-19 | Weinar |
| 4,454,702 | | 1984-06-19 | Bonilla-Lugo et al. |
| 4,336,676 | | 1982-06-29 | Artzer |
| 4,292,783 | | 1981-10-6 | Mulvihill |

U.S. patent application Publications

| Publication No. | Kind Code | Publ. Date | Applicant |
|---|---|---|---|
| 2010/0058700 | A1 | 2010-03-11 | LeBlang |
| 2009/0107065 | A1 | 2009-04-30 | LeBlang |
| 2009/0218474 | A1 | 2009-09-3 | Bowman |
| 2009/0133343 | A1 | 2009-05-28 | Tedder |
| 2003/0070379 | A1 | 2003-04-17 | Worley |
| 2001/0000844 | A1 | 2001-05-10 | Kubica |

-continued

Non-published U.S. patent applications

| application Ser. No. | Filing Date | Applicant |
|---|---|---|
| 13/374,839 | 2012-01-17 | Kreizinger |
| 13/373,816 | 2011-12-1 | Kreizinger |

This invention reveals a method of building insulated concrete walls by minimizing the freshly mixed concrete's hydrostatic pressure and using a special stud that supports and secures insulation boards used as stay-in-place forms. When used in this method, the insulation boards and stud substantially reduce the cost of an insulated, cast-in-place concrete wall.

Cast-in-place insulated concrete walls have become an important building feature and are built in a variety of ways. One method of building cast-in-place insulated concrete walls is to place insulation boards inside two concrete forms and cast concrete on one or both sides of the insulation board. The insulation boards are secured in the form's center or on one or both sides of the form after which concrete is cast into the form. During casting, the "wet" concrete produces a hydrostatic pressure on the forms that can reach up to two thousand pounds per sq. ft. of form area and must be counteracted with very strong forms and form ties. This makes forming concrete a costly process and placing insulation boards inside two forms does nothing to reduce these costs. Not only does the insulation board have added material costs, there are manufacturing and/or labor costs associated with the necessity of passing form ties through the insulation boards, inside the forms, such that the form ties connect the two forms to withstand the hydrostatic pressure.

Another method of using insulation boards to build cast-in-place insulated concrete walls is as stay-in-place, insulated concrete forms (ICF) which are used to replace conventional, removable forms. These ICF systems typically have two pieces of a foamed insulation board that provide two stay-in-place foam forms which are held together and spaced apart by connecting ties, webs or frames. These connecting ties, webs or frames counteract the hydrostatic pressure by holding the two foam forms together during the casting process. One feature of these systems is that the ties, webs or frames also provide a stud-like material to which wallboard may be attached.

However, all of the ICF systems are based on conventional casting of concrete, which produces high levels of hydrostatic pressure on the insulation board forms. To counteract this high pressure, numerous connecting ties, webs or frames are placed closely together—typically as close as 6 to 12 inches apart. This results in a large number of ties and frames that greatly increases both the material costs and the labor necessary to assemble these systems. While thicker insulation boards may be used to reduce the number of connecting ties or frames, any cost savings is offset by the higher cost of thicker foam boards. In addition, thick insulation boards would result in thicker walls which are undesirable for many structures.

The ICF systems also require specially shaped and fabricated foam board forms that work specifically with each company's special connecting tie, web or frame. When the costs of the special foam forms, the ties, webs or frames and the labor to assemble are added together, these systems become costly and only slightly less expensive than inserting insulation boards in conventional forms. In addition, the numerous ties, webs and frames and the block like foam forms of the ICF systems prohibits the use of wire mesh as an inexpensive concrete reinforcement and also make it difficult to place rebars. Finally, the ICF systems result with an insulation board as the face of the exterior side of the wall which requires additional work to prepare it for certain exterior wall claddings.

A third method of building cast-in-place insulated concrete walls is with so called 3D panels. These 3D panels have wire mesh embedded through and on both sides of an insulation board, to which concrete is pneumatically applied with shotcrete or gunite. Since pneumatically placed concrete has little or no hydrostatic pressure, the insulation boards may be relatively thin. The wire mesh acts to both reinforce the concrete and hold the two sides of concrete and the insulation board together. The end product is a concrete wall with insulation board sandwiched between two thin skins of concrete. While functional, these 3D panels have proved to be unpopular due to the high cost of the wire mesh encased foam panels and the fact most consumers do not want concrete as the finish for an interior wall. As such, the concrete on the interior side must be framed out and covered with a more desirable interior wallboard.

One prior art, U.S. Pat. No. 4,292,783, uses foam insulating slabs with separate sheets of wire mesh placed over these slabs, which are then sprayed with gunite to achieve a concrete wall. While less expensive than the 3D panels, this system also results in an undesirable concrete finish on the interior side of the wall which must be framed out and covered with a wallboard.

The present invention is a simple and low cost alternative to concrete forms, ICF and 3D panels used in building insulated, cast-in-place concrete walls. The low cost is achieved by using off-the-shelf insulation boards as one-sided forms for low hydrostatic pressure producing concrete. The lack of hydrostatic pressure enables the insulation board forms to be thin and require minimal bracing. Moreover, there are no form ties, webs or frames to connect two forms together. Special studs are used on the interior side only and may be spaced up to 24 inches apart. These studs are used to support and/or secure the insulation boards and to provide a solid base for the attachment of wallboards and wall hangings. This system also provides an open work area for placing inexpensive wire mesh and conventional rebars. The end result is an insulated, reinforced concrete wall with a concrete exterior, ready for any type of finish and an interior side with insulation board and studs ready for wiring and wallboards, all at a cost much less than other systems.

SUMMARY OF INVENTION

This invention is a method of building low cost insulated concrete walls by minimizing the freshly mixed concrete's hydrostatic pressure and using a special stud that supports and/or secures simple rectangular shaped insulation boards used as stay-in-place forms on one side of the wall. The construction process is simple beginning with the vertical positioning of the studs and insulation boards on one side of the wall and secured with minimal bracing. Steel reinforcement is placed next to the backside of the insulation boards and a low or no-slump concrete is placed against the reinforcement, the backside of the stud and the insulation board. The concrete's hydrostatic pressure is minimized or eliminated by either pneumatically spraying it or by using the concrete's thixotropic properties. The lack of hydrostatic pressure eliminates the need for a conventional form to support the insulation board and stud as well as the need for form ties, webs or frames used to hold forms together. As the concrete cures, it causes the stud to become a sturdy member, sufficient to secure the insulation board and wallboard that may be affixed to the stud. The insulation board used as a one-sided form requires only minimal bracing.

While the pneumatically sprayed concrete that can be used is well known in the art, placing methods based upon utilizing the thixotropic properties to reduce the hydrostatic pressure on the insulation board and stud is new art. Thixotropy is a material property that describes a material as being in a solid or semi-solid state when at rest and the ability to becoming liquefied when agitated. Thixotropy is a property of freshly mixed no-slump or low-slump concrete in that this type of concrete is in a semi-solid state, similar to moist, clumpy dirt, when at rest and becomes liquefied when vibrated. Since hydrostatic pressure is only present when a liquid state exists, limiting the amount of a liquid or semi-liquid concrete present at any one time will limit the amount of hydrostatic pressure present. Moreover, the liquefaction is temporary in that as soon as the vibration ceases, the concrete immediately reverts to its semi-solid state and stops exerting hydrostatic pressure.

Applicant has two copending applications wherein the thixotropic properties of low or no-slump concrete are used in the placement of the concrete. The first is a Vertical Vibrating Screed as disclosed in applicant's copending application Ser. No. 13/373,816 filed 1 Dec. 2011 and the second is copending application Ser. No. 13/374,839 filed 17 Jan. 2012 entitled the Thixotropic Concrete Forming System. Both of these copending applications are incorporated by reference.

An important aspect of this invention is the stud to which wallboard may be attached after the concrete cures. Most building codes require that wallboards be mechanically attached to the wall and the stud provides a solid member to facilitate such attachment as well as support wall hangings. The stud also acts to secure the insulation board from weather before casting and from the concrete cast and liquefied against the insulation board. The stud also eliminates the need to separately frame the insulation board side of the wall to facilitate attaching wallboard or similar wall cladding.

In the preferred embodiment of this invention, the stud and insulation board comprise a stay-in-place form that remains in position after the concrete is cured and provides insulating features to the structure. The insulation board may be made of any rigid material and is generally rectangular in shape.

In the one embodiment of this invention the studs are specially shaped with a generally flat flange section to which a generally perpendicular tail is attached. The tail may be of any length that extends beyond the backside of the insulation board and into the cavity where the concrete is to be cast. The tail also has a means for embedding into the fresh concrete as it is cast and liquefied and thereafter bonds to the concrete as it hardens. The flange section of the stud provides a rigid member to which wallboard may be attached. The studs may be made of any material which is sufficiently rigid or is made sufficiently rigid as the concrete hardens so as to enable wallboard to be attached to the stud.

In another embodiment braces hold the stud and/or the insulation boards in place both before and during concrete casting. Once the concrete hardens, the insulation boards are sandwiched between the flange or cross member of the stud and the hardened concrete.

In another embodiment of the invention, the studs have a cross member that may extend the entire length on a full length tail such that a channel is formed between the cross member and the stud's flange. When an insulation board is placed in this channel, it forms a seal to prevent water intrusion from one side of the insulation board to the other side.

In another embodiment of this invention the studs are configured to have a flange on both sides of the wall to which wallboard or other claddings may be attached.

BRIEF DESCRIPTION OF THE DRAWINGS

FIG. 21A is a section view of the side a "H" shaped doubled flanged stud of this invention.

FIG. 21B is a plan view showing the "H" shaped stud positioned between insulation boards.

FIG. 22A is a section view of the side of a double flanged stud showing the two pieces prior to their being connected.

FIG. 22B is a plan view of the two pieces of the double flanged stud of FIG. 22A.

FIG. 23 is a section view of the side of the two piece stud of FIG. 22A, having been connected with insulation board in position.

FIG. 24 is a plan view of an alternative connecting method of the two pieces for the double flanged stud.

FIG. 25A is a plan view of a cross bar that stabilizes the double flanged studs of this invention.

FIG. 25B is a plan view showing the cross bar connecting two double flanged studs on one wall face and insulation boards positioning the studs on the second wall face.

DETAILED DESCRIPTION ACCORDING TO THE PREFERRED EMBODIMENTS OF THE PRESENT INVENTION

This invention is a method of building low cost insulated concrete walls by minimizing the hydrostatic pressure of the freshly mixed concrete and using a special stud that supports and/or secures simple rectangular shaped insulation boards used as forms on one side of the wall.

Figure 1A:
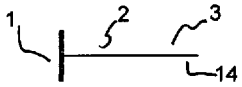
FIG. 1A is a plan view of the stud of this invention.

The stud 3 of this invention has one or more flanges 1, one or more tails 2, one or more end of tails 14 and a means for bonding the stud to the concrete. The stud 3 may also have a means for securing the insulation board to the stud. FIG. 1A is the most simplified configuration showing a flange 1 of the stud 3 and a tail 2. The flange 1 is generally flat and perpendicular to the tail 2 and may be used as the element to which wallboard or other wall claddings are attached to the stud 3. The tail 2 is the element that extends from the backside of the flange 1 of the stud 3 and passes through or between the insulation board and into the cavity in which the concrete is cast. For purposes of this invention the word "through" may be used to describe the tail 2 as either passing through the material of an insulation board or passing between two adjacent insulation boards. The end of tail 14 is the part of the tail 2 exposed on the backside of the insulation board and provides the mechanism for bonding the stud 3 to the concrete. Two of several different mechanisms for bonding the stud 3 to the concrete are a protrusion 5 shown in FIG. 1B and a deformation 6 as shown in FIG. 1C.

Figure 1B:
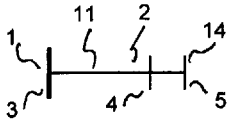
FIG. 1B is a plan view of another configuration of the stud of this invention showing a channel created by the stud's flange and a cross member.
Figure 1C:
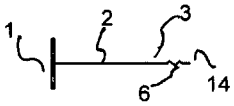
FIG. 1C is a plan view of another configuration of the stud of this invention.

FIG. 1B also shows the stud 3 with a flange 1 and a tail 2 and also a cross member 4 that creates a channel 11 in conjunction with the flange 1 to provide an area into which the insulation board is fitted. The channel 11 secures the insulation board to the stud 3. When the tail 2 and the cross member 4 runs the full length of the stud 3 and an insulation board is placed in the channel 11, a water tight seal can be created to prevent water intrusion from the outside to the inside of the wall. Various adhesives or sealant materials may be placed in the channel 11 to improve the water tight seal. Sealants or adhesives may be placed on the backside of the flange 1 or the tails 2 in any stud 3 configuration to provide a waterproof seal or to secure the insulation board 8 to the stud 3.

Figure 2:
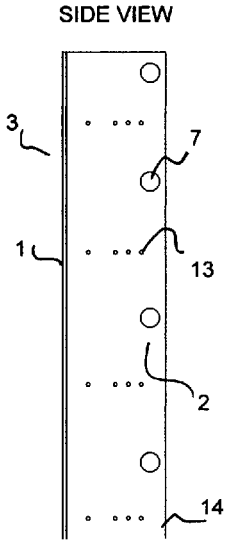
FIG. 2 is a section view of one configuration of the stud of this invention.

The tail 2 of the stud 3 may also have bonding holes 7 and pin holes 13 punched into the tail 2 as shown in a side view of the stud 3 in FIG. 2. The bonding holes 7 are holes exposed on the end of tail 14 and large enough for the liquefied concrete to flow through to enable another way to bond the stud 3 to the concrete. The pin holes 13 are much smaller and are used to secure the insulation board 8 to the stud 3 by either placing a pin through the pin hole 13 located on the immediate backside 10 of the insulation boards 8 or by placing a pin through the pin hole 13 and into the side of the insulation board as is more clearly seen in FIGS. 18A and 18B.

Figure 3:
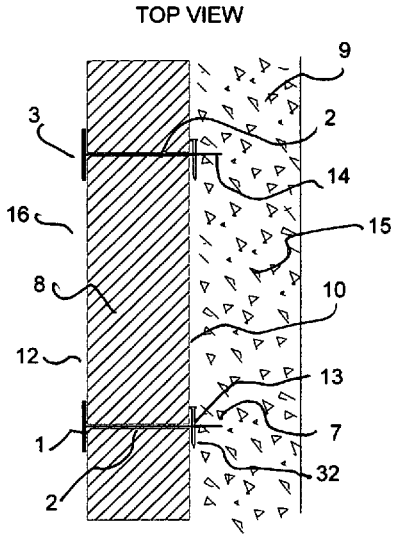
FIG. 3 is a plan view of the stud with its tail embedded in concrete and an insulation board sandwiched between the stud and concrete.

FIG. 3 is a top view showing the studs 3 with their flanges 1 on the front side 12 of the insulation boards 8 and the tails 2 passing through insulation boards 8 and continuing beyond the backside 10 of the insulation board 8 such that the end of tails 14 are exposed in the casting area 15. The casting area 15 is the area into which freshly mixed concrete is cast during the placement of the concrete wall. During the concrete's placement, the concrete 9 passes into the bonding holes 7 to enable the stud 3 to bond to the concrete 9. Also in FIG. 3, the flange 1 is shown securing the insulation boards 8 that are sandwiched between the concrete 9 and the flange 1 of the stud 3. Drywall or other wallboards may be easily attached to the flange 1 of the stud 3 by fasteners including screws, nails, adhesive materials and other bonding methods known in the art. Also shown in FIG. 3 is a pin with a head 32 that was slipped through a pin hole 13 to secure the insulation board 8 to the stud 3 prior to and during the placement of the concrete 9.

It is important to note that the insulation boards 8 and the studs 3 are simply positioned together, stood vertically and braced. As such, the insulation boards 8 and the studs 3 comprise a stay-in-place form 16 which is defined as a form in and of itself and does not use other forms for bracing. As a stay-in-place form 16 the insulation boards 8 and studs 3 are only braced by commonly used horizontal and vertical bracing well known in the art. In this configuration the flange 1 of the stud 3 is on the front side 12 of the insulation board 8 and the tail 2 extends through the backside 10. The freshly mixed no-slump concrete is then placed on the backside 10 of the insulation boards 8 using a process that greatly reduces the hydrostatic pressure that is typically present in wet concrete. It is the significant reduction in the concrete's hydrostatic pressure that enables the insulation boards 8 and studs 3 to be used as stay-in-place forms 16.

The reduction of the hydrostatic pressure may be accomplished by pneumatically spraying the concrete or by a new process that uses the thixotropic properties of no-slump concrete during its placement (for purposes of this invention, the term "no-slump" concrete shall include "low slump" concrete).

Pneumatically spraying the concrete is commonly known as gunite for a dry concrete mixture and shotcrete for a wet concrete mixture. Both of these pneumatically applied methods are well known in the art and have been used for more than 40 years. In both of these pneumatically applied processes, the concrete is sprayed against the stay-in-place form 16 comprised of the insulation boards 8 and stud 3. After the desired concrete thickness is reached, the excess concrete is struck off and the concrete may be left rough or may be finished to the desired appearance.

The new process of reducing the concrete's hydrostatic pressure uses the thixotropic properties of no-slump concrete. Thixotropy is a material property that describes a material as being in a solid or semi-solid state when at rest and becoming liquefied when agitated. Freshly mixed no-slump concrete is a highly thixotropy material in that the concrete is in a semi-solid state when at rest and becomes liquefied when vibrated. Since hydrostatic pressure is only present when a liquid state exists, limiting the amount of a liquid or semi-liquid concrete present at any one time will limit the amount of hydrostatic pressure present. Moreover, the liquefaction is temporary in that as soon as the vibration ceases, the concrete immediately reverts to its semi-solid state and stops exerting hydrostatic pressure.

When placing freshly mixed no-slump concrete it is initially at rest and in its semi-solid state while being cast into the casting area 15 and thereby is exerting little or no hydrostatic pressure. However, as soon as the concrete is vibrated during the placement process it becomes a semi-liquid exerting hydrostatic pressure and is temporarily liquefied to the point that it is able to flow to fill the casting area, encase the embedments and become consolidated. Importantly, when the vibration ceases, the no-slump concrete immediately reverts to its semi-solid state and stops exerting hydrostatic pressure. Therefore, the hydrostatic pressure can be significantly reduced by using no-slump concrete and minimizing the amount of concrete being liquefied (vibrated) at any one time. This results in the ability to use relatively weak insulation boards 8 and studs 3 as stay-in-place forms 16 on one side of the wall without support from other forms, form ties or frame connections to a second form.

As used herein, the terms place, placing or placement when used regarding concrete, refers to the process of casting, vibrating and the flowing, i.e. distribution of the concrete.

The means for placing temporarily liquefied no-slump concrete is based upon the above described process of reducing the hydrostatic pressure and specifically include the disclosures contained in two copending applications. The first copending application is a Vertical Vibrating Screed disclosed in application Ser. No. 13/373,816 filed Dec. 1, 2011 and the second is copending application Ser. No. 13/374,839 filed Jan. 17, 2012 entitled the Thixotropic Concrete Forming System. Both of these copending applications are incorporated by reference and are two means for placing a temporarily liquefied no-slump concrete.

The means for placing temporarily liquefied no-slump concrete using the Thixotropic Concrete Forming System copending application uses a tall form-short form combination set of concrete forms comprised of at least one tall form side of vertically faced forms erected to the full height that is to be monolithically placed and at least one short form side comprised of erecting multiple levels of vertically faced short forms stacked above one another with each level filled with concrete, vibrated, consolidated and integrated in a horizontal progression before the next level is erected and repeating this process to the full height of the monolithically placed structure.

The means for placing temporarily liquefied no-slump concrete using the Vertical Vibrating Screed copending application is described as: (a) positioning a vertically oriented backstop on at least one side of a vertical structure to be cast and then positioning a vertically oriented screed a predetermined space apart from the backstop and the screed has a face facing the backstop; (b) casting a highly thixotropic cementicious material into a hopper attached to the screed and the hopper feeds the material into a casting area between the face and the backstop where the material is liquefied, consolidated and spread in the casting area; (c) as the screed moves in a vertical direction, it shapes the outside face of the material with the screed and a trailing slip form; (d) eliminating the seams between the material placed in a present pass with the material placed in any previous adjacent pass with a seam form which is a lateral extension to the screed and that overlaps the seam; (e) the screed is supported and guided in a predetermined direction while maintaining a predetermined distance from the backstop to complete a pass; and (f) the above steps are repeated for any successive pass until a wall, column or other vertical structure are cast.

Figure 4A:
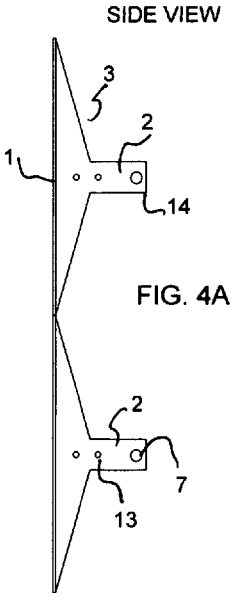
FIG. 4A is a section view of another configuration of the stud of this invention.
Figure 4B:
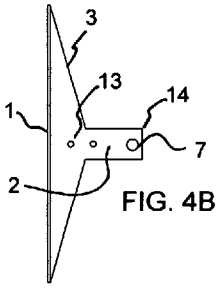
FIG. 4B is a section view of another configuration of the stud of this invention.

The stud 3 may be made of plastic, metal, wood or other materials or a combination of materials and may be extruded, molded or otherwise shaped or assembled. There may also be a variation in the shape and configuration of the stud 3 to include having multiple flanges 1, tails 2 and end of tails 14. For example FIG. 4A shows a full length stud 3 that has a flange 1, two tails 2, two end of tails 14 and bonding holes 7 to enable the stud 3 to bond to the concrete. Pin holes 13 are also present to secure the insulation board 8 to the stud 3. FIG. 4B shows the same configuration except the stud 3 is a short section that may be set adjacent to or spaced apart other such sections. Other configurations of the stud 3 will become apparent below.

Figure 5A:
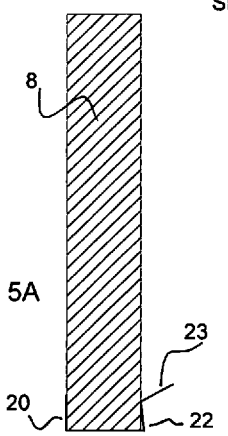
FIG. 5A is a section view showing a bottom wall perimeter member attached to an insulation board.
Figure 5B:
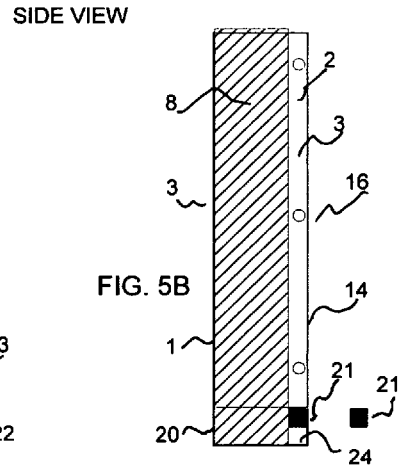
FIG. 5B is a section view showing the stud and insulation board connected to the bottom perimeter member.

The stud 3 may be used by itself or in conjunction with perimeter members 20. FIGS. 5A and 5B show two perimeter members of different configurations at the bottom of a wall section. The perimeter members 20 are used at the top and/or bottom of walls and around the perimeter of window and door openings. The perimeter members 20 provide a solid material into which screws or nails may be placed or glue used to secure wallboard. When used as a top or bottom perimeter member, the vertically positioned studs 3 simply butt up to the perimeter member 20 as shown in FIG. 5B.

The tall form-short form combination is comprised of form boards that may be of any size and may have a rectangular or irregularly shaped form face that may be multi-directional, horizontally or vertically oriented. The form boards may be removable or stay-in-place and made of any material including foam, wood, plastic, metal, paper, cardboard, glass, ceramic, brick, stone or a composite. As such, the form boards include finished claddings that may be used as form boards, adhere to the concrete and stay-in-place after casting. The form boards may also be used to support forms liners.

Also in FIGS. 5A and 5B, it is shown how the insulation boards 8 fit inside the perimeter members 20. In FIG. 5A, the perimeter member 20 has slightly bent rear section 22 into which a insulation board 8 may be pressure fitted. This perimeter member 20 also has a tail section 23 that is embedded into the concrete cast behind the insulation board 8.

In FIG. 5B, a "U" shaped perimeter member 20 is revealed and the insulation board 8 that is not as thick as the "U" shaped perimeter member 20 is wide. The insulation board 8 is placed into the perimeter member 20 and pushed to the flange of the perimeter member 20 and there is an open area 24 between the rear of the insulation board 8 and the rear of the perimeter member 20. In order to hold the insulation board 8 firmly against the flange of the perimeter member 20, a wedge 21 is placed between the rear of the perimeter member 20 and the rear of the insulation board 8. Wet concrete is then filled into the open area 24 and when the concrete cures, the perimeter member 20 is firmly bonded to the concrete and the insulation board 8 is firmly positioned to the flange of the perimeter member 20.

The perimeter member 20 may also be attached to the slab or foundation or other floor or to headers, columns or beams and other such structural members present in the building (not shown).

A top of wall backstop may be screwed to the top perimeter member and overhang the area into which the concrete is to be placed. This top board (not shown) acts as a backstop or form for the top of the wall when concrete is sprayed against the top form board. After the concrete is cured, the top form board may be removed or it may remain in place and provide a means for attaching trusses to the wall. The top form board may also provide a straight edge on which the sprayed concrete may be struck along the length of the wall.

Figure 7:
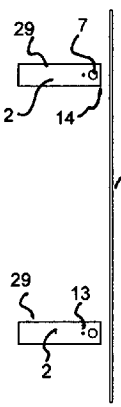
FIG. 7 is a section view showing the side of the stud and the tails ready to attach to the stud.
Figure 6:
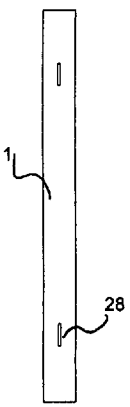
FIG. 6 is a section view showing the flange of a two piece stud with slots.

FIGS. 6 through 9 shows another configuration of the stud 3 that is made from multiple parts but also having a flange 1, a tail 2, an end of tail 14 that is capable of bonding the stud 3 to the concrete. The first part is shown in FIG. 6 and is a front view of a flange 1 that has slots 28. FIG. 7 shows the side view of the flange 1 and shows the inserts 29 that slip through the slots 28 in the flange 1 to form a "T" stud 3 in which the inserts 29 provide the tail 2 to the stud 3. FIG. 8A shows the side view of a completed "T" stud 3 of this configuration and also shows the top view of the "T" insert 29 that provides the tail 2 and that has a "T" flange 25. In FIG. 8A the "T" inserts 29 have been slid through the slots 28 to create a "T" stud 3 with a tail 2. FIG. 8B shows a front view of the stud 3 and the "T" flange 25 that is the front section of the "T" insert 29 that has been slid through the slots 28 of the flange 1. FIG. 8C shows a top view of FIGS. 8A and 8B. The tail 2 of this invention has several means by which it is connected to the flange 1 including sliding through holes or slots, molded together and/or chemically bonded.

Figure 9:
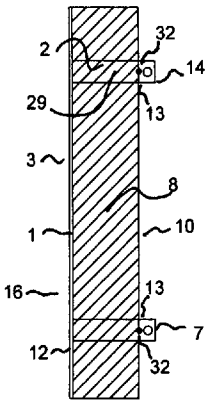
FIG. 9 is a section view showing the stud and tails penetrating and securing the insulation boards.
Figure 8B:
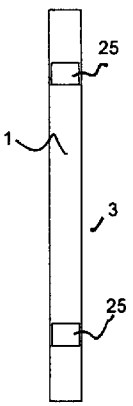
FIG. 8B is a section view showing the flange front with the tails inserted into the slots.
Figure 8C:
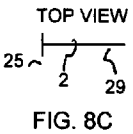
FIG. 8C is a top view of FIGS. 8A and 8B.
Figure 8A:
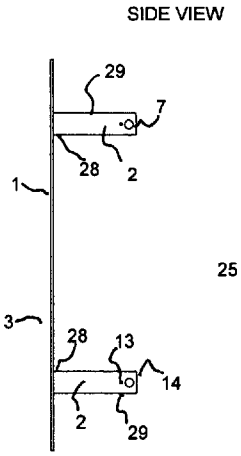
FIG. 8A is a section view showing the stud's flange and tails connected.

FIG. 9 shows a side view of stud 3 from FIG. 8A that has been passed through or between insulation boards 8. The flange 1 is on the front side 12 of the insulation board 8 and the "T" insert 29 is also the tail 2 that extends through the insulation board 8 and beyond the backside 10, all of which comprise the stay-in-place form 16. When the concrete is placed against the backside 10 it embeds and bonds with the bonding holes 7 on the end of tail 14. Also shown is the pin with a head 32 on the immediate backside 10 of the insulation board 8 that was placed through the small pin holes 13 to secure the insulation board 8 to the stud 3.

Figure 12:
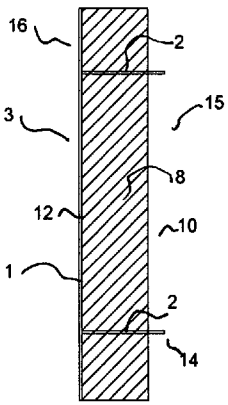
FIG. 12 is a section view showing the stud and rods of FIG. 11 penetrating and securing the insulation board.
Figure 11:
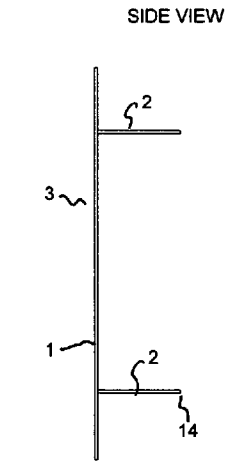
FIG. 11 is a section of a one piece stud with rods as its tails.
Figure 10B:
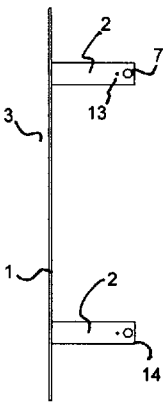
FIG. 10B is a section view of the side of a one piece stud.
Figure 10A:
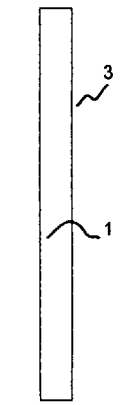
FIG. 10A is a section view of the front of a stud.

FIGS. 10 through 12 is another configuration of the stud 3 that is made by injection molding or similar process. The stud 3 of this configuration also has a flange 1, multiple tails 2 and end of tails 14 that is capable of bonding the stud 3 to the concrete. FIG. 10A is the front view of the flange 1 of the stud 3. FIG. 10B is the side view showing the tails 2 spaced apart and molded to the flange 1 to create the stud 3. The stud 3 of this configuration may be in shorter sections that are stacked or otherwise placed adjacent to one another or spaced apart or the stud 3 may be molded as a full length stud.

While FIGS. 10A and 10B show a blade type configuration of the tail 2 that passes through the insulation boards, FIG. 11 shows rod shaped tails 2. For both the blade and the rod configuration, the stud 3 may be positioned on the insulation board by punching the blade or the rod tail 2 through the insulation board as opposed to placing the stud 3 between individual insulation boards. FIG. 12 shows a side view of the stay-in-place form 16 comprised of a stud 3 with multiple rod tails 2 that has been pushed through the insulation board 8 such that the flange 1 is against the front side 12 of the insulation board 8 and the end of tail 14 is beyond the backside 10 of the insulation board 8 and into the casting area 15.

Figure 13A:
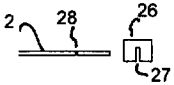
FIG. 13A is a section view showing the side of a tail and a front view of the locking device.
Figure 13B:
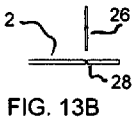
FIG. 13B is a section view showing a side view of the tail and the locking device.
Figure 13C:
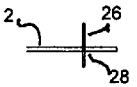
FIG. 13C is a section view showing the locking device positioned on the tail.

FIGS. 13A, 13B and 13C show another method of securing the insulation board 8 to the stud 3. In this configuration a locking device 26 may be slipped over the tail 2 so as to secure the stud 3 to the insulation board 8. In FIG. 13A, the locking device 26 has a slot 27 that is to be slid over an indentation 28 in the tail 2. The tail 2 may be either a rod type of FIG. 11 or a flat section as shown in FIG. 10B. FIG. 13B shows the locking device 26 perpendicular to the tail 2 and positioned above the indentation 28 ready for positioning over the tail 2. FIG. 13C shows the locking device 26 positioned on the tail 2 by having been slid over the indentation 28. In this manner the insulation board (not shown) is secured between the locking device 26 and the stud's flange (not shown) in order to hold them together before and during the casting of the concrete. The locking device 26 is one of many ways of securing the insulation board to the stud which includes using an adhesive to bond the insulation board to the stud 3.

Figure 14:
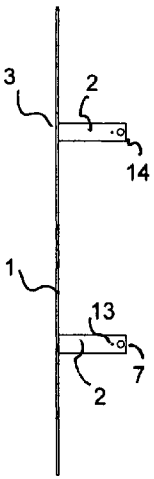
FIG. 14 is a section view showing the side of a stud with two separate tails.
Figure 15:
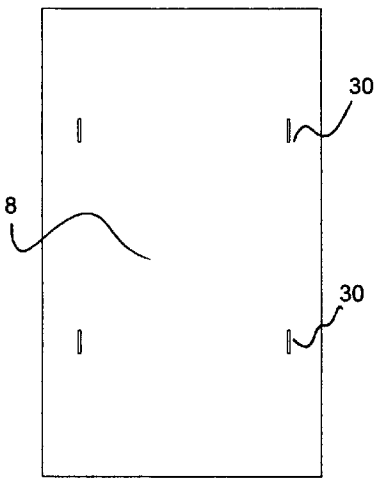
FIG. 15 is a section view of the front of an insulation board with four slots.
Figure 16:
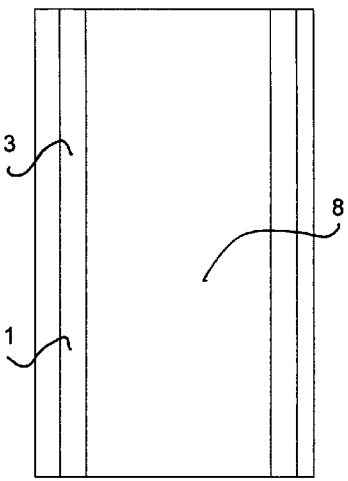
FIG. 16 is a section view showing the stud of FIG. 14 having been attached to the insulation board of FIG. 15.
Figure 17:
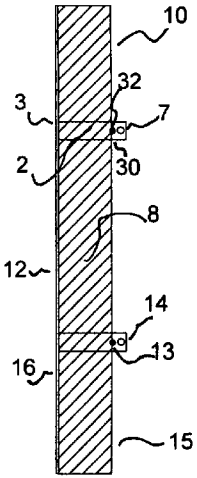
FIG. 17 is a section of a side view of FIG. 16 showing the tails penetrating the slots and extending beyond the backside of the insulation board.

FIGS. 14 through 17 show another configuration of this invention where the insulation board 8 is punched with holes or slots 30 through which the blade or rod tail 2 configuration may pass. FIG. 14 shows a stud 3 that has a flange 1 and two spaced apart tails 2. FIG. 15 shows a slotted insulation board 8 in which slots 30 have been made through the entire depth of the insulation board 8. The slots 30 are positioned such that the tails 2 will fit through the slots 30. FIG. 16 is a front view that shows the stud 3 having been positioned onto the insulation board 8 that has the slots as shown in FIG. 15. FIG. 17 is a side view of FIG. 16 and shows the stay-in-place form 16 with the stud 3, the flange 1 against the front side 12 of the insulation board 8 and the tails 2 passed through the slots 30 such that the end of tail 14 is in the casting area 15.

Figure 18A:
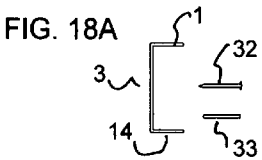
FIG. 18A is a plan view of a "C" shaped configuration of the stud of this invention.
Figure 18B:
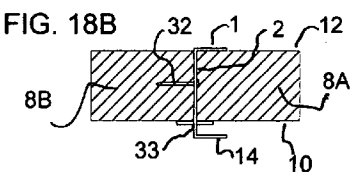
FIG. 18B is a plan view showing the stud of FIG. 18A positioned between two insulation boards.

The stud of this invention may also be of different shapes and configurations as shown in the following examples. FIGS. 18A and 18B show a "C" shaped stud 3. As shown in FIG. 18A, the stud 3 has a flange 1, a tail 2 and an end of tail 14, which is spaced away from the insulation board and perpendicular to the tail 2 and thereby provides a mechanism for bonding the stud to the concrete. In FIG. 18B, one insulation board 8A is set inside the "C" shaped stud 3 and the combination of the flange 1 and straight pin 33 secure the insulation board 8A to the stud 3. The second adjacent insulation board 8B is held in place by a pin with a head 32 that passes through a pin hole 13 in the tail 2 and into the insulation board 8B and thereby secure the insulation board 8B to the stud 3.

Figure 19A:
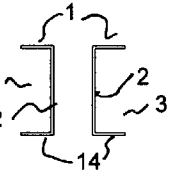
FIG. 19A is a plan view of a "C" shaped studs in a back-to-back configuration.
Figure 19B:
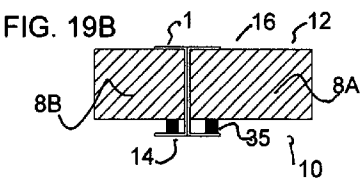
FIG. 19B is a plan view showing the stud of FIG. 19A positioned between two insulation boards.

FIGS. 19A and 19B show two back to back "C" shaped studs 3, flanges 1, tails 2 and the end of tails 14 which are perpendicular to the tails 2. In this configuration the insulation boards 8A and 8B are set in their respective positions next to the tail 2 and the flange 1. This leaves the end of tails 14 away from the backside 10 of the insulation boards 8A and 8B and enables the stud 3 to bond to the concrete. In this configuration the insulation boards 8A and 8B may be secured to the stud 3 with the straight pin 33 from FIGS. 18A and 18B or by a wedge 35 that fits between the end of tail 14 and the insulation boards 8A and 8B as shown in FIG. 19B.

Figure 20A:
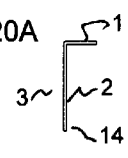
FIG. 20A is a plan view of a "L" shaped stud of this invention.
Figure 20B:
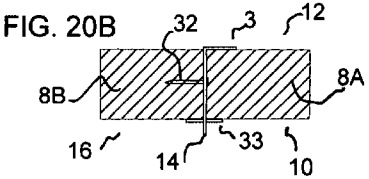
FIG. 20B is a plan view showing the stud of FIG. 20A positioned between two insulation boards.

FIGS. 20A and 20B show another configuration of the stud 3 of this invention. In FIGS. 20A and 20B, the stud 3 is shaped as an inverted "L" and has a flange 1, a tail 2 and an end of tail 14 that is capable of bonding the stud 3 to the concrete (not shown). The insulation board 8A is held in place by a headed pin 32 secured to the tail and insulation board 8B is held in place by the straight pin 33 and the flange 1, both securing the insulation boards 8A and 8B to the stud 3.

Two inverted "L" shaped studs may be used for inside corners or a single "Y" shaped stud may be used (not shown). Outside corners may be studded with an arrow shaped stud that has two flanges at a right angle to each other and a single tail that extends to the concrete.

Another embodiment of this invention are configurations that provide a means for positioning a second flange on the wall's second side in order to permit wallboard, siding, paneling or similar wall claddings to be attached to the flanges on both sides of the concrete wall. A flange on the concrete side of the wall also provides a strike-off surface to facilitate striking off the excess concrete when pneumatically sprayed concrete is used.

FIGS. 21A shows a side view and 21B shows a top view of a configuration that positions a second flange on the wall's second side. In this configuration an "H" shaped stud 3 that has a flange 1, a tail 2 and an end of tail 14 that is "T" shaped like the flange 1. The "T" shaped end of tail 14 provides both a second flange 1 and a way to bond the stud 3 to the concrete. When an "H" stud 3 is used the insulation board 8 is positioned against the inside of the flange 1 and a headed pin 32 is used to secure the insulation board 8 to the stud 3. The "T" shaped end of tail 14 is positioned on or adjacent to the outside of the casting area 15 and when the concrete is cast, the end of tail 14 provides a flange to which wall claddings may be attached. As shown in the following figures, the "T" shaped end of tail 14 may be thickened to allow nails, screws or other fasteners to penetrate the stud 3B a sufficient depth without being stopped by the concrete. The thickened flange may be solid or it may be hollow.

FIGS. 22A, 22B, 23 and 24 shows a configuration that provides another method for positioning a second flange on the wall's second side. FIG. 22A shows a stud 3 comprised of a first stud 3A with a flange 1A, a tail 2A and an end of tail 14A with bonding holes 7. A second stud 3B also has a flange 1B, a tail 2B and an end of tail 14B to which a knob 41 is attached. The knob 41 is of the size and shape that fits tightly into the bonding holes 7 of the first stud 3A. FIG. 22B is a top view of the first stud 3A and the second stud 3B with the knob 41 and a flange 1B that is thickened 42.

FIG. 23 is a side view that shows the first stud 3A connected to the second stud 3B by the end of tail 14B knob 41 snapping into the end of tail 14A bonding hole 7. When the two end of tails 14A and 14B are connected, the end of tail 14B and the protruding knob 41 are protruding from either side of the bonding hole 7 and thereby will bond the stud 3 to the concrete. One advantage of using studs 3A and 3B to combine into a single stud 3 instead of the "H" shaped stud is that wire mesh 43 or other steel reinforcement may be placed in the casting area before the studs 3A and 3B are connected. It is much easier to place the concrete reinforcement and use wire mesh when one side is open rather than having to fish the rebar through the "H" shaped stud described above.

FIG. 24 shows another means for connecting stud 3A to stud 3B. In this configuration the end of tail 14A is round 44 and may be snapped into a fitting 45 that is attached to the end of tail 14B on the second stud 3B. The insulation board 8 may be secured to either stud 3A or 3B some distance away from the end of tails 14A and 14B. The round 44 on the end of tail 14A and the fitting 45 on end of tail 14B when snapped together provide a method of bonding the studs to the concrete.

FIGS. 25A and 25B shows a cross bar 50 that connects adjacent studs 3 so as to stabilize them and hold them in position while the concrete is placed around them. The cross bar 50 has slots 51 to allow it to slide over the tails 2. The cross bars 50 and the tails 2 create a frame that holds the studs 3 in position while concrete is placed into the casting area 15.

Figure 26:
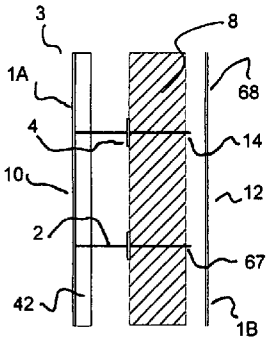
FIG. 26 is a section view of a stud with a thicker body and with an extended rod like tail that penetrates through and beyond the backside of the insulation board and a second stud flange with a track ready to install.
Figure 27:
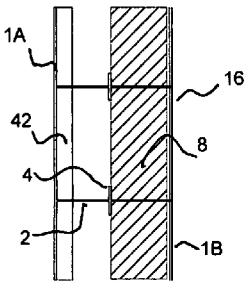
FIG. 27 is a section view of FIG. 26 with the second stud flange having been attached to the extended tail.

FIGS. 26 and 27 show another configuration that provides a method for positioning a second flange on the wall's second side. In FIG. 26 a stud 3 is shown with a thickened 42 flange 1A, tails 2 and an end of tail 14 that has a slider 67 attached. Also shown is a cross member 4 used to secure the insulation board 8 to the stud 3 and rod like tails 2 that penetrate the insulation board 8 until the slider 67 on the end of tails 14 is exposed. Finally, a second flange 1B with a track 68 is shown ready to be slid onto the sliders 67 attached to the end of tails 14.

As shown in FIG. 27, the two stud flanges 1A and 1B are connected to one another from the front side 12 and the backside 10 of the wall when the second flange 1B slides its track 68 over the sliders 67 on the end of tails 14. This locks the stud 3 and flanges 1A and 1B together with the insulation board 8. The mechanism for bonding the stud 3 to the concrete provided by sliding the flange 1B over the end of tail 14.

Figure 28:
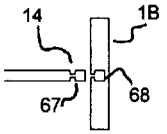
FIG. 28 is a plan view showing how the stud's flange slide and the rod like extension connect in FIG. 27.

FIG. 28 is an enlargement of the end of tail 14 with the slider 67 attached and the flange 1B with the track 68 ready to be slid over the slider 67. Once the slider 67 is attached to the end of tail 14, the flange 1B is connected to the stud 3.

Figure 30:
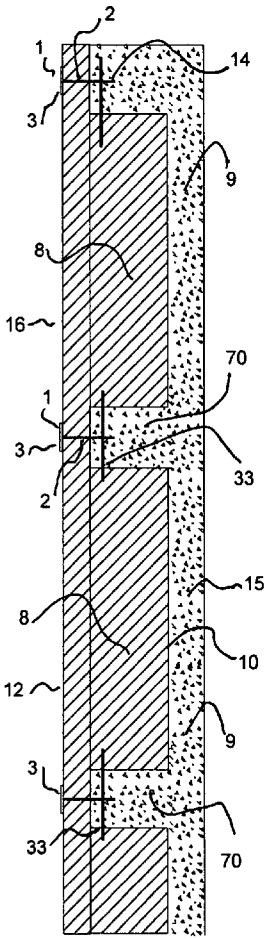
FIG. 30 is a plan view of another configuration of an insulated concrete wall with a thin skin of concrete supported by thicker concrete ribs to which the studs are connected.
Figure 29:
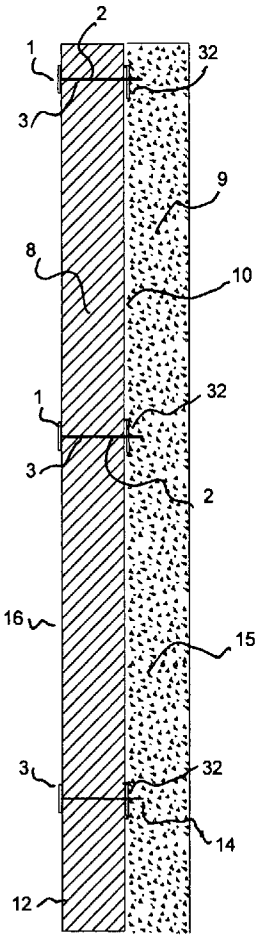
FIG. 29 is a plan view of an insulated concrete wall of this invention with studs connected to the concrete and insulation boards sandwiched between the stud's flange and the concrete.

The insulation boards may be rectangular shaped and placed in the same plain as shown in a top view of FIG. 29 or the insulation boards may have irregular shapes as shown in a top view of FIG. 30. In FIG. 29 headed pins 32 slid through pin holes 13 to secure the insulation board to the stud and the end of tail 14 has one of several previously described mechanisms for bonding the stud 3 to the concrete 9. In FIG. 29 the insulation boards 8 and the concrete 9 are both of uniform depth. In FIG. 30 both the insulation boards 8 and the concrete 9 are of varying depths that create concrete ribs 70 in the wall section. Such a configuration provides for a thin skin of concrete 9 covering the entire wall which is structurally supported by the concrete ribs 70 that are of greater depth and strength. Also in FIG. 30 a straight pin 33 is used to secure the insulation boards 8 to the stud 3.

Figure 31:
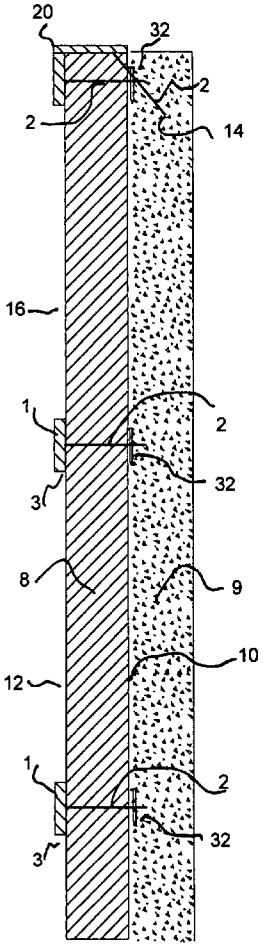
FIG. 31 is a plan view of a stud of this invention with the flange made out of wood and the tails made out of nails or bolts that penetrate the insulation boards to connect to the concrete.

FIG. 31 shows another configuration of this invention whereby wood is used as the flange 1 of the stud 3. In this configuration the tail 2 is comprised of a nail, bolt, screw, hook or other device that is fastened to the wood flange 1 and extends through the insulation boards 8 until the end of tail 14 is exposed on the backside 10 of the insulation board 8. The wood flange 1 may be recessed into the insulation boards or may be fully exposed on the front of the insulation boards. The end of tails 14 in this configuration have been roughened, bent, threaded, deformed or have an object such as a nut or pin attached or have a material attached such as epoxy or galvanization to enable the stud to bond to the concrete.

The insulation boards of this invention may be cut into certain widths that are separated by the studs of this invention or the insulation boards may be connected together by a tongue and groove or a "U" shaped interlocking feature. If the insulation boards are connected together, the studs and tails are punched through the insulation boards at the desired locations as revealed in FIGS. 10 through 17.

From the description above, a number of advantages of some embodiments of my method of building insulated concrete walls become evident:

(a) The present invention is a simple and low cost alternative to concrete forms, ICF and 3D panels used in building insulated, cast-in-place concrete walls.

(b) The significant reduction in the concrete's hydrostatic pressure enables an insulation board and a stud to combine into a stay-in-place form with only bracing required.

(c) The reduced hydrostatic pressure also eliminates the need for form ties, webs or frames used to connect to a second form which reduces material and labor costs.

(d) The low hydrostatic concrete also allows the use of off-the-shelf, inexpensive insulation boards as stay in place forms, replacing metal or wood forms or expensive ICF systems.

(e) The studs of this invention may be spaced up to 24 inches apart which is much farther than ICF studs that are only 8 to 12 inches apart. This results in both a material and labor savings.

(f) An insulation board on only one side produces a concrete finish on the second side to which an elastomeric texture may be inexpensively applied.

(g) The integral studs provide a screwable solid surface to which wall boards and other wall claddings may be attached without additional framing as required for 3D systems.

What I claim is:

1. A method of building an insulated cast-in-place concrete wall comprising:

a. positioning a multitude of vertically oriented insulation boards at predetermined locations and each having at least one stud with a flange positioned on a front side of said insulation board and securing said insulation board to said stud, to create a stay-in-place form, and each said stud having one or more tails extending perpendicular from said flange through and emerging from a backside of said insulation boards a predetermined distance to expose an end of tail that bonds said stud to said concrete wall, b. bracing said stay-in-place form, c. means for placing temporarily liquefied no-slump concrete against said backside to fill a predetermined area, whereby an insulated, cast-in-place concrete wall is built with studs ready for wall cladding to be attached to said flange.

2. The method of building an insulated cast-in-place concrete wall of claim 1 further including positioning a second flange on said wall's second side.

3. The method of building an insulated cast-in-place concrete wall of claim 1 further including said stud having a channel to contain said insulation board.

4. The method of building an insulated cast-in-place concrete wall of claim 1 further including a sealant placed on said studs to seal said studs to said insulation boards.

5. The method of building an insulated cast-in-place concrete wall of claim 1 including the use of perimeter members comprising:

a. two or more sides of which one or more sides provides a rigid, generally flat surface to which wallboard may be attached, b. positioning said perimeter members at the top and bottom of the interior side of said walls and at the inside corners created by openings in said wall, c. the second or more said sides of said perimeter members wrap over or around the corner of said insulation boards and said perimeter members are permanently connected to the building structure, whereby said perimeter members provide a rigid, secured surface to which wallboard may be attached at the top and bottom of said walls and around window and door said openings.

6. A method of building an insulated cast-in-place concrete wall comprising:

a. positioning a plurality of vertically oriented insulation boards at predetermined locations and each having at least one stud, said stud comprising:

an elongated member having a flange securing said insulation boards to said stud, one or more tails connected perpendicular to said flange and extending horizontally from said flange a distance greater than the thickness of said insulation boards and emerging from a backside of said insulation boards a predetermined distance to expose an end of tail that bonds said stud to said concrete wall, creating a stay-in-place form, b. bracing said stay-in-place form, c. means for placing temporarily liquefied no-slump concrete against said backside to fill a predetermined area, d. bonding said stud to said concrete, whereby said studs secure said insulation boards, bonds to said concrete and provides a rigid member to which wallboard or other wall claddings may be attached.

7. The stud of claim 6 further including a channel to hold said insulating board.

8. The stud of claim 6 further including a sealant placed on said stud to provide a seal between said stud and said insulating board.

9. The stud of claim 6 further including positioning a second flange on said wall's second side.

10. The stud of claim 9 further including thickening said second flange to enable fasteners to penetrate deep into said flange to provide a firmer fastening.

* * * * *